US007959414B2

(12) United States Patent
Schwarz et al.

(10) Patent No.: US 7,959,414 B2
(45) Date of Patent: Jun. 14, 2011

(54) CONTROL SYSTEM AND METHOD FOR PROTECTION AGAINST BREAKAGE OF LUBRICANTING-OIL FILM IN COMPRESSOR BEARINGS

(75) Inventors: Marcos Guilherme Schwarz, Joinville (BR); Roberto Andrich, Joinville (BR); Fabio Henrique Klein, Joinville (BR)

(73) Assignee: Whirlpool S.A., Sao Paulo-SP (BR)

( * ) Notice: Subject to any disclaimer, the term of this patent is extended or adjusted under 35 U.S.C. 154(b) by 948 days.

(21) Appl. No.: 11/815,781

(22) PCT Filed: Apr. 27, 2006

(86) PCT No.: PCT/BR2006/000079

§ 371 (c)(1),
(2), (4) Date: Aug. 8, 2007

(87) PCT Pub. No.: WO2006/116829

PCT Pub. Date: Nov. 9, 2006

(65) Prior Publication Data

US 2008/0145240 A1 Jun. 19, 2008

(30) Foreign Application Priority Data

Apr. 29, 2005 (BR) ..... 0501446

(51) Int. Cl.

| | |
|---|---|
| ***F04B 49/10*** | (2006.01) |
| ***F04B 49/06*** | (2006.01) |
| ***G05F 1/10*** | (2006.01) |

(52) U.S. Cl. ..... 417/13; 417/44.11; 417/53; 388/806

(58) Field of Classification Search ..... 417/13, 417/44.11, 53, 228; 388/800, 806, 815, 821–823; 318/361

See application file for complete search history.

(56) References Cited

U.S. PATENT DOCUMENTS 3,411,313 A * 11/1968 Brown et al. ..... 62/192

(Continued)

FOREIGN PATENT DOCUMENTS

| | | |
|---|---|---|
| EP | 0 664 424 | 7/1995 |
| JP | 62 029852 | 2/1987 |
| WO | WO 95/15468 | 6/1995 |

OTHER PUBLICATIONS

The International Search Report for PCT Application No. PCT/BR2006/000079; Filed Apr. 27, 2006; Date of Completion Aug. 18, 2006; Date of Mailing Aug. 29, 2006.

(Continued)

*Primary Examiner* — Charles G Freay
(74) *Attorney, Agent, or Firm* — Alston & Bird LLP

(57) ABSTRACT

The present invention relates to a control system for protection against breakage of the lubricating-oil film in the bearings of hermetic compressors, as well as to a control method that has the objective of guaranteeing that a variable-capacity compressor should be maintained above a minimum rotation in order to prevent the oil film close to the respective bearing from breaking. One of the forms of achieving the objectives of the present invention is by means of a control system for protection against break of the lubricating-oil film in bearings of hermetic compressors, a microprocessor (10) actuating a set of switches (SW2M) selectively, so as to generate a rotation at the motor-compressor assembly (20, 21), the compressor (21) having a minimum rotation (RPMmin) of the compressor (21) so that the oil film will not be broken.

26 Claims, 5 Drawing Sheets

(a)

(b)

U.S. PATENT DOCUMENTS

| | | | | |
|---|---|---|---|---|
| 5,446,354 | A * | 8/1995 | Hiruma | 318/400.21 |
| 6,431,843 | B1 * | 8/2002 | Dudley | 417/281 |
| 6,853,523 | B1 * | 2/2005 | Schwarz et al. | 361/23 |
| 7,331,766 | B2 * | 2/2008 | Barowsky et al. | 417/13 |
| 2004/0032230 | A1 | 2/2004 | Schwarz et al. | |

OTHER PUBLICATIONS

The Written Opinion for PCT Application No. PCT/BR2006/000079; Filed Apr. 27, 2006.

* cited by examiner (a)

(b)

CONTROL SYSTEM AND METHOD FOR PROTECTION AGAINST BREAKAGE OF LUBRICANTING-OIL FILM IN COMPRESSOR BEARINGS

The present invention relates to a control system for protection against breakage of lubricating-oil film in hermetical compressor bearings, as well as to a control method that has the objective of guaranteeing that a variable-capacity compressor will be maintained above a minimum rotation, in order to prevent the oil film close to the respective bearing from breaking.

DESCRIPTION OF THE PRIOR ART

Variable-capacity compressors used in cooling provide a considerable economy of energy, as compared with traditional fixed-velocity compressors. This economy may range from 20% to 45%. One of the factors that contribute most to this reduction in the consumption is the possibility of working at low rotations. While a traditional compressor operates always around 3000 rpm (50 Hz) or 3600 rpm (60 Hz), a variable-capacity compressor may work with average rotations of about 1600 rpm. This value may vary, depending upon the design of the oil pump and upon the configuration of the oil paths on the crankshaft. Specifically for centrifugal oil pumps, it is not possible to guarantee a minimum volume of oil necessary for lubricating all the mechanical parts of the compressor by working with lower values.

By way of example, in the present case one will use the minimum rotation value of 1600 rpm. However, the methodology described is valid for any minimum rotation value that, as mentioned, may vary from compressor to compressor.

An option for obtaining an additional reduction of the mechanical losses in a variable-capacity compressor is the use of lubricating oils having less viscosity. A less viscous oil would reduce the loss by viscous friction in compressor bearings and, consequently, would increase its efficiency. On the other hand, this would cause problems for conditions of high condensation temperature and low rotation, increasing the probability of the lubricating-oil film that exists in compressor bearings breaking, which would cause mechanical wear of these parts and would seriously impair their functioning.

Among various techniques of protection against high compression pressure in existing compressors, we can cite those described in these patent documents: US 2002018724, CN1311397, U.S. Pat. No. 5,975,854, HK 210896, EP 1500821, WO 9623976. These techniques are characterized by the use of protection sensors and/or protection valves for interrupting the functioning of the compressor when critical levels of pressure are reached. In the proposed technique, one uses an indirect sensing of the pressure conditions under which the compressor is operating. This sensing is made by a microprocessed system for controlling compressors. When a critical pressure value is identified, the rotation value is conformed to a safe value, that will guarantee the permanence of lubricating oil in compressor bearings.

OBJECTIVES OF THE INVENTION

One of the objectives of the invention is to protect compressor bearings from the solid friction caused by the beak of oil film when operating at a low rotation and under high compression (discharge) pressures.

Another objective of the invention is to enable the use of less viscous oils, with a view to increasing the efficiency of a compressor.

A further objective of the invention is to use a microprocessed system of controlling an electric motor for ensuring protection without the need to add sensors to a hermetic compressor.

A further objective of the invention is to monitor and control the functioning condition of a compressor by measuring magnitudes thereof, without the need to add external sensors.

BRIEF DESCRIPTION OF THE INVENTION

The objectives of the present invention are achieved by means of a control system for controlling a hermetic compressor, wherein the load applied to the compressor bearings is directly sensed by sensing rotation oscillation level or the torque (which define a bearing-situation variable), transmitted by the electric motor to the compressor axle. A microprocessor present in the system, analyzing this bearing-condition variable or rotation-oscillation level or torque raises the rotation value of the electric motor up to a predetermined value, so as to guarantee that there will be no break of oil film in the compressor bearings.

The system comprises a compressor, an electric motor associated to the compressor, a microprocessed control circuit that measures the level of the bearing-situation or rotation-oscillation variable during a mechanical turn of the compressor or the torque present on the compressor axle. The values measured are compared with predetermined values for checking whether the compressor is operating in pressure conditions that, depending upon the rotation, could cause the oil film in the bearings to break and, consequently, lead to wear of these mechanical parts. If the values of the bearing-situation variable kept by the microprocessor are higher than the predetermined values, the compressor rotation is raised by a predetermined rate, guaranteeing the permanence of the oil film.

According to a first preferred embodiment of the present invention, if one opts for measuring the bearing-situation variable from the measurement of rotation oscillation, the position sensing used in controlling the electric motor of the compressor will inform the instant of commutation of the power switches of the control system. These instants of commutation are in N number during one mechanical turn of the compressor, N being dependent upon the number of phases and poles of the motor. The time passed between successive commutations is stored by the microprocessor for estimating the rotation oscillation. In situations of low loads on the axle of the compressor motor, the N instants of commutation are equally spaced apart in a mechanical turn. However, when the compressor is subjected to high compression pressures and suction, a significant unbalancing of the load occurs during a mechanical turn, and the spacing between the N instants of commutation becomes quite irregular. During the compression cycle (half mechanical turn), the commutation instants become more spaced apart, and in the suction cycle (half mechanical turn) the commutation instants are more close to each other. Taking the difference between a minimum commutation time $t_{MIN}$ and a maximum commutation time $t_{MAX}$, time between two commutations in one turn, added to the average commutation time $t_{MED}$ and dividing it all by the average commutation time $t_{MED}$, one obtains the oscillation parameter $K_{OSC}$, which supplies an information about the rotation-oscillation level of the compressor motor. This oscillation parameter decreases as the compressor rotation is raised, since in this case there is an increase in mechanical inertia that reduces the oscillation level. When this parameter reaches a predetermined value of the oscillation parameter $K_{MAX}$, the motor rotation should be raised so as to keep it always below this value.

According to a second embodiment of the present invention, if one opts for measuring the bearing-situation variable from the measurement of the torque on the axle of the electric motor associated to the compressor, one will find that, by measuring this magnitude or another magnitude that is proportional to the load existing on the motor axle, as for example the current that circulates through the motor, one can also get an idea of the levels of discharge pressure and suction to which the compressor is subjected. Thus, when the torque value exceeds a predetermined value, one checks a table correlating torque and minimum rotation, where one verifies at which rotation value the compressor should operate, so as to guarantee that the bearings will not be damaged due to the break of oil film. The torque values that result in adjustments of the minimum rotation of the electric motor are dependent upon a number of magnitudes, as for example, compressor model, amounts and types of oil, conditions of pressure, temperature of the electric motor, etc., and thus do not assume a constant relation. Therefore, the adequate correlation between torque and minimum rotation is defined taking such parameters into consideration.

One of the forms of achieving the objectives of the present invention is by means of a control system for protection against break of the lubricating-oil film in the bearings of hermetic compressors comprising an electric motor of M phases associated with the compressor, forming a motor-compressor assembly, the compressor having a bearing, the bearing being covered with a lubricating film, a microprocessor, an inverter comprising a set of switches, the inverter being connected to a voltage and associated to the microprocessor, the inverter modulating the voltage for feeding the motor, a voltage observer measuring the voltage level at the inverter exit and a current observer measuring the current circulating through the set of switches of the inverter, associated to the microprocessor, the microprocessor selectively actuating the set of switches, so as to generate a rotation in the motor-compressor assembly, the compressor having a minimum rotation of the compressor, so that the oil film will not break, the microprocessor being configured to describe, on the basis of the information of the voltage observer and current observer, a bearing-situation variable, the bearing-situation variable having a maximum foreseen value, the microprocessor raising the motor rotation, so that the latter will be above the minimum rotation, and the bearing-situation variable can be obtained on the basis of the voltage observer associated to the microprocessor, the microprocessor monitoring a time of permanence of the motor in each of the positions defined throughout the motor rotation for obtaining the bearing-situation variable on the basis of the calculation of an oscillation parameter or on the basis of the torque close to the motor axle.

Another manner of achieving the objectives of the present invention is by means of a method for protection against break of the lubricating-oil film in bearings of hermetic compressors, the compressor being driven by an electric motor, an inverter being connected to the voltage, the inverter being driven to feed the motor and thus to cause a rotation on the motor, the method comprising the steps of establishing a bearing-situation variable from the observation of the voltage and of the current on the inverter; establishing a maximum value foreseen for the bearing-situation variable; raising the motor rotation according to a pre-established relation, so as to prevent the breakage of the oil film in the compressor bearings.

DETAILED DESCRIPTION OF THE FIGURES

Figure 1:
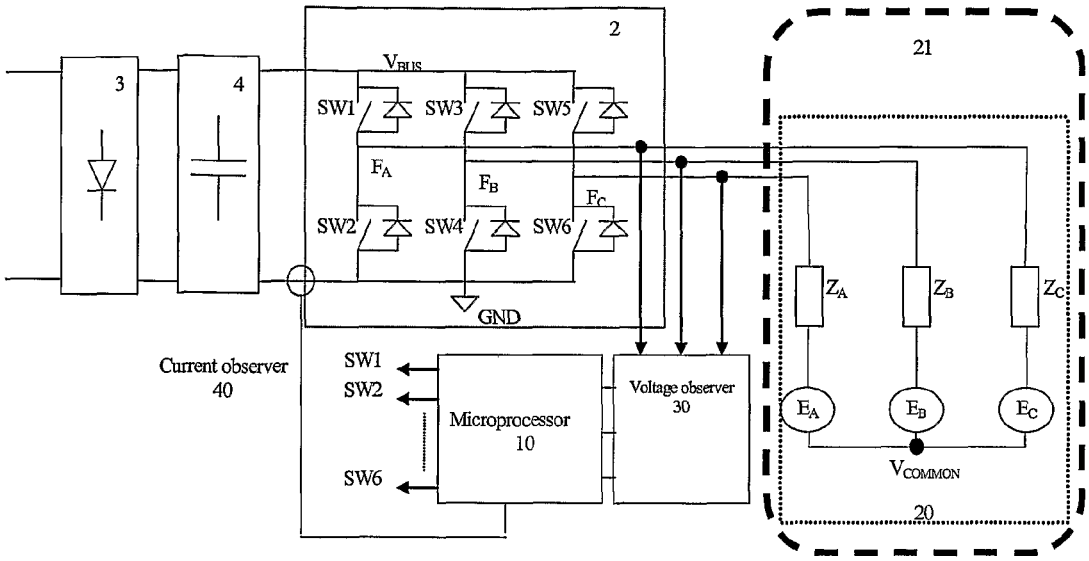
FIG. 1*a* represents a schematic diagram of the control system for controlling the electric motor of the compressor according to the teachings of the present invention.
FIG. 1*b* represents the waveforms characteristics of the actuation of an electric motor associated to the compressor.
Figure 1:
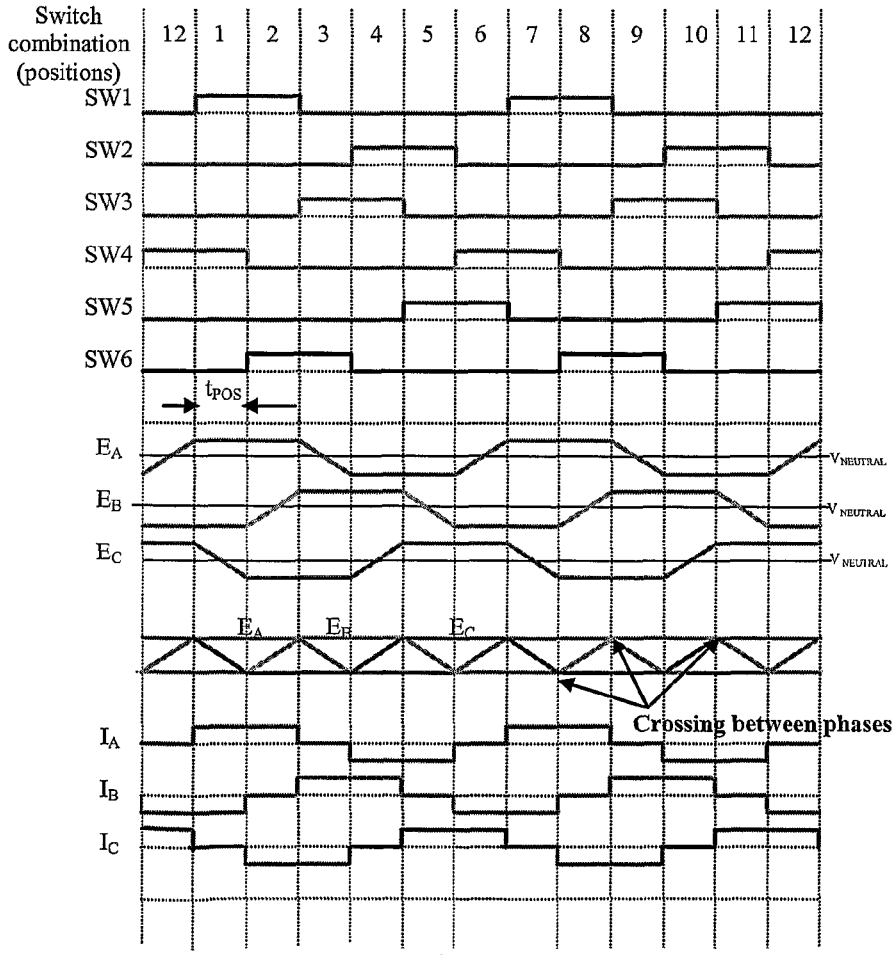

According to FIG. 1*a*, the control system of the electric motor of the compressor is formed by a hermetic compressor 21, an M-phase electric motor 20 (in the example, a three-phase motor is illustrated) associated to the compressor 21, a voltage observer used by the microprocessor 10 for sensing the position of the electric motor 20, an inverter 2 formed by an Y number of power switches SW1, Sw2, SW3, SW4, SW5 and SW6, a rectifier circuit 3 associated to a filter 4 for converting the AC voltage at the input of the DC voltage system to be used by the inverter 2. The electric motor 20 is represented internally by the induced voltage sources EA, EB and EC and the impedances ZA, ZB and ZC. The microprocessor 10, by means of the voltage observer 30, reads the voltages induced by the electric motor EA, EB and EC and at the instant when two of the voltages cross each other, it generates a sequence of actuation of the power switches SW1, Sw2, SW3, SW4, SW5 and SW6 indicated in FIG. 1*b*. In all, there are N combinations (positions) of switches per mechanical turn of the compressor, wherein N depends on the number of phases M and on the number of poles P of the electric motor. The motor control method is described in detail in patent document U.S. Pat. No. 6,922,027, incorporated herein by reference.

According to the teachings of the present invention, there are two embodiments of protection against break of the oil film in the compressor bearings. According to a first embodiment, the bearing-situation variable is measured on the basis of the oscillation parameter $K_{OSC}$ for activating the protection and, according to a second embodiment of the present invention, the bearing-situation variable is measured on the basis of the value of torque on the motor axle.

Figure 2:
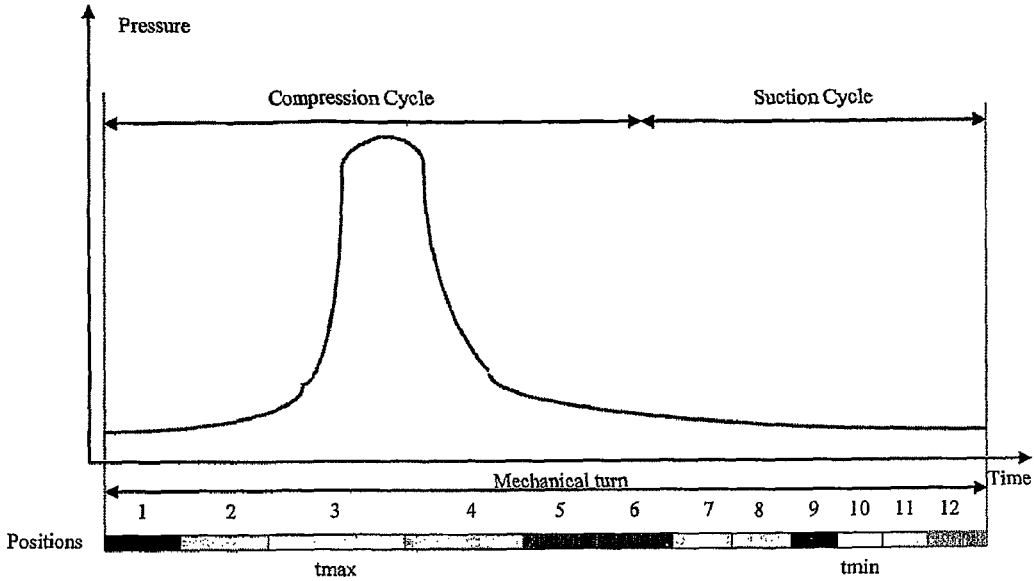
FIG. 2 represents a behavior curve of the compressor pressure versus the motor commutation time during a turn of the electric motor, on the basis of which one obtains the calculation of the rotation-oscillation parameter $K_{OSC}$.

FIG. 2, according to a first embodiment of the present invention, illustrates one of the forms of measuring and monitoring the bearing-situation variable, specifically by measuring the rotation oscillation, defining an oscillation constant $K_{OSC}$, illustrating specifically and schematically the shape of the pressure curve in the compression chamber of the compressor 21 during the mechanical turn. In the same figure, one represents the N instants of commutation (positions) of the switches SW1 . . . SW6 referring to the actuation of the electric motor 20. When the load on the bearings of compressor 21 axle is low, the interval between the N instants of commutation is virtually uniform, but, as the load increases, this interval undergoes variations. In the compression cycle, when the piston is compressing gas, the motor undergoes a deceleration, causing a longer spacing between commutation instants (see stretch of highest deceleration in position 3 and where the maximum commutation time $t_{MAX}$ is defined). In the suction cycle, when the compressor 21 piston 21 is again sucking the gas, the motor accelerates, and thus the commutation instants are closer together (see stretch of highest acceleration in position 10, where the minimum commutation time $t_{MIN}$ is defined.). Taking the longer interval between two commutations and the maximum commutation time $t_{MAX}$, the shorter interval of time between the commutations, or minimum commutation time $t_{MIN}$ and the value of the mean between the N intervals or the average commutation time $t_{MED}$, the oscillation index or parameter $K_{OSC}$ is calculated:

$$K_{OSC} = \frac{t_{MAX} - t_{MIN} + t_{MED}}{t_{MED}} \quad \text{(eq. 1)}$$

wherein, for the illustrated embodiment, $$t_{MED} = \frac{t_1 + t_2 + \ldots + t_{12}}{12} \quad \text{(eq. 2)}$$

or in a generic way:

$$t_{MED} = \frac{t_1 + t_2 + \ldots + t_N}{N} \quad \text{(eq. 3)}$$

This index informs the level of oscillation present on the axle of the electric motor 20 during one mechanical turn. If the load on the compressor 21 is low, this index will have maximum value of 1 (one). As the load increases, this index gets away from the unitary value.

Figure 3A:
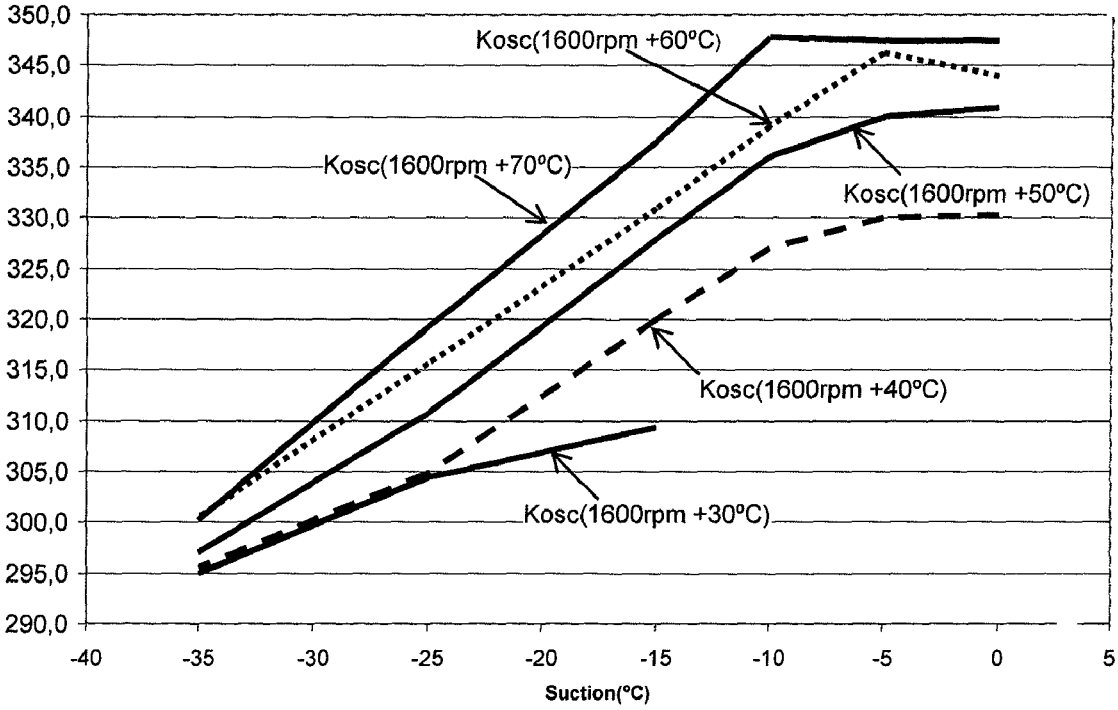
FIG. 3*a* represents the curves indicating the variation of the rotation-oscillation parameter with the compression and suction pressures for a compressor operating at an average speed of 1600 rpm.
Figure 3B:
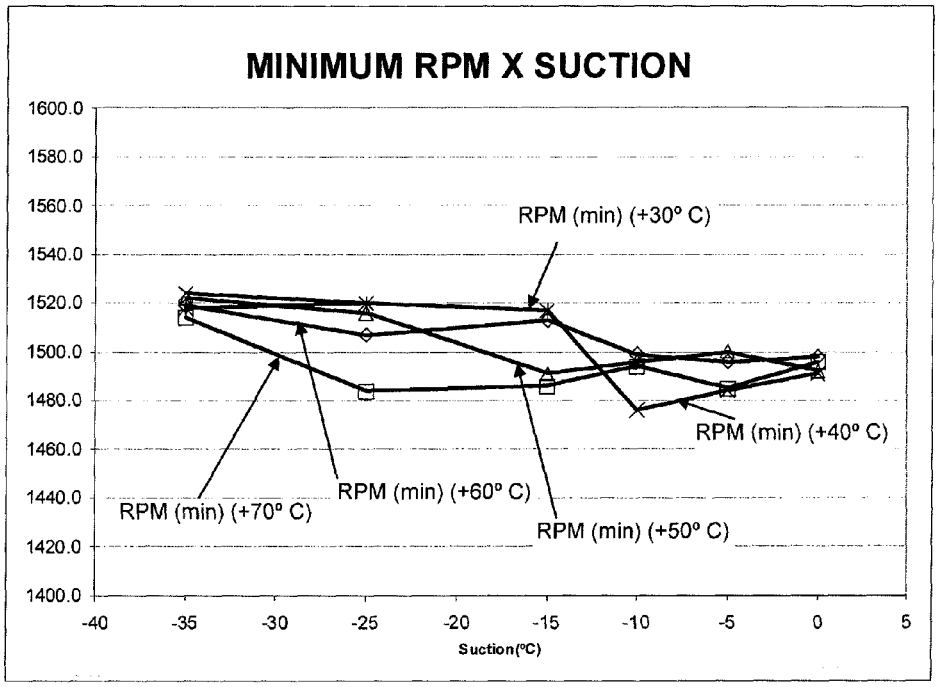
FIG. 3*b* represents the curves indicating the minimum constant rotation of 1500 rpm (average of 1600 rpm) at which one detects the compressor during the raising of the curves of FIG. 3*a;*
Figure 4A:
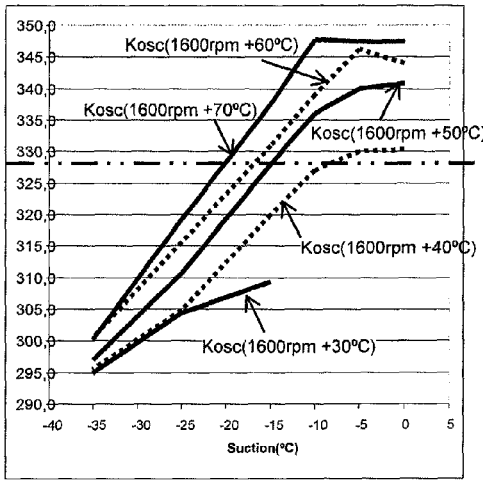
FIG. 4*a* represents the repetition of FIG. 3*a*, illustrating by the line $K_{MAX}$ the maximum oscillation parameter $K_{MAX}$ of the oscillation parameter $K_{OSC}$, above which the protection from break of the oil film according to the teachings of the present invention is activated.
Figure 4B:
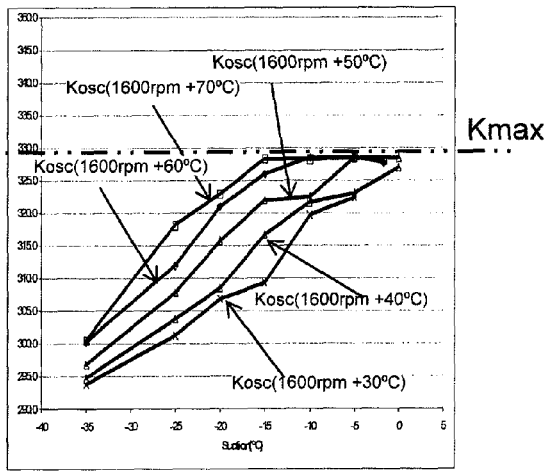
FIG. 4*b* represents the curves of variation of the oscillation parameter $K_{OSC}$, with the protection system according to the teachings of the present invention.
Figure 4C:
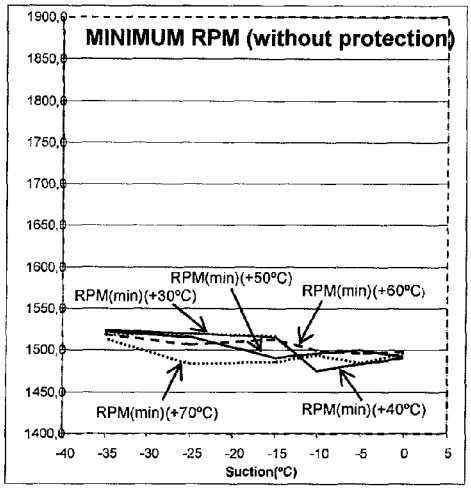
FIG. 4*c* represents the repetition of FIG. 3*b* for a direct comparison with FIG. 4*d;*
Figure 4D:
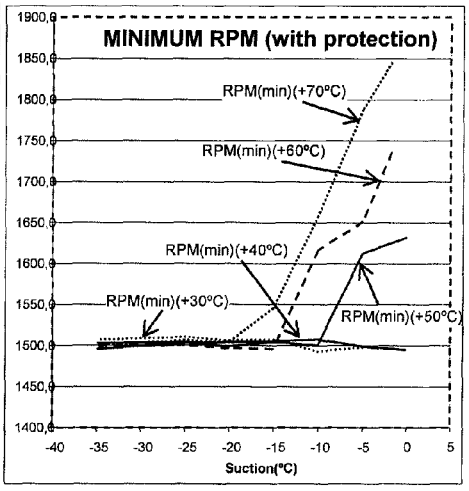
FIG. 4*d* represents the curves illustrating the increase of minimum rotation of the compressor caused by the activation of the protection system against break of the film oil, using the oscillation parameter $K_{OSC}$ according to the teachings of the present invention.

When the oscillation parameter $K_{OSC}$ is used, one monitors the value of this parameter. When the value of the parameter $K_{OSC}$ reaches or exceeds a maximum value of the oscillation parameter $K_{MAX}$, the rotation of the motor 20 should be raised so as to keep the value of the oscillation parameter $K_{OSC}$ always lower than the maximum value of the oscillation parameter $K_{MAX}$. The increasing in rotation entails an increase in the value of the oscillation parameter $K_{OSC}$ due to the increase in inertia on the motor 20 axle, generating a lower level of oscillation. By way of example, in FIG. 3*a* one has raised the curves of oscillation variation $K_{OSC}$ according to the pressures of condensation and evaporation of a variable-capacity compressor. On the abscissa axis we have the evaporation pressure, expressed with its corresponding values in degrees Celsius, ranging from −35° C. to 0° C. and each line of the curves represents a different condensation pressure, also expressed in degrees Celsius, ranging from +30° C. to +70° C. In FIG. 3*b*, one presents, for instance, the minimum compressor rotation fixed at 1500 rpm for all the conditions of compression and suction. This minimum rotation is the value corresponding to the longer time between the commutations during one turn. In the case of FIG. 3, the system has been put to work without activation of the protection via oscillation parameter $K_{OSC}$. In FIG. 4*a*, the curves of FIG. 3*a* have been repeated, and one has included a dashed line indicating the maximum value of oscillation parameter $K_{MAX}$, selected for this case. In FIG. 4*b*, one shows the curves of the oscillation parameter $K_{OSC}$, now with protection activated according to the control system of the present invention. One observes that, in this case, the curves do not exceed the maximum value of the oscillation parameter $K_{MAX}$. FIG. 4*c* is a repetition of FIG. 3*b*, made for direct comparison with FIG. 4*d*. In FIG. 4*d*, one shows the rotation value of the compressor 21 the different conditions of the test effected with active protection. It should be noted that the increase in rotation to more than 1500 rpm is caused by the control system of the present invention in order to keep the value of the oscillation parameter $K_{OSC}$ below the maximum value of the oscillation parameter $K_{MAX}$.

The maximum value of the oscillation parameter $K_{MAX}$ will depend on minimum rotation desired for the compressor 21 and on the viscosity of the lubricating oil used.

According to the other preferred embodiment, one may opt for monitoring the bearing-situation variable by measuring the torque T on the motor 20 axle, with the objective of protecting the compressor 21 against the break of the oil film.

When the torque T on the motor axle as a parameter for activating the protection, the procedure is quite similar to that used with the value of the oscillation parameter $K_{OSC}$. The torque value is calculated by the microprocessor 10 on the basis of the acquisitions of current on the current observer 40. The torque T is proportional to the average current and can be calculated by means of the expression:

$$T = C_M \times I_{MED} \quad \text{(eq. 4)}$$

wherein $C_M$ is a constant that depends on the design of the motor and $I_{MED}$ is the average current in the motor 10 in ampere. One can also use the expression:

$$T = \frac{C_N \times C_M \times P}{R} \quad \text{(eq. 5)}$$

wherein P is power consumed by the inverter 2 in watts, calculated from the voltage observer 30 and from the current observer 40, Cn is an adjustment constant and R is the rotation value of the motor 20 associated to the compressor 21 given in rpm.

Figure 5A:
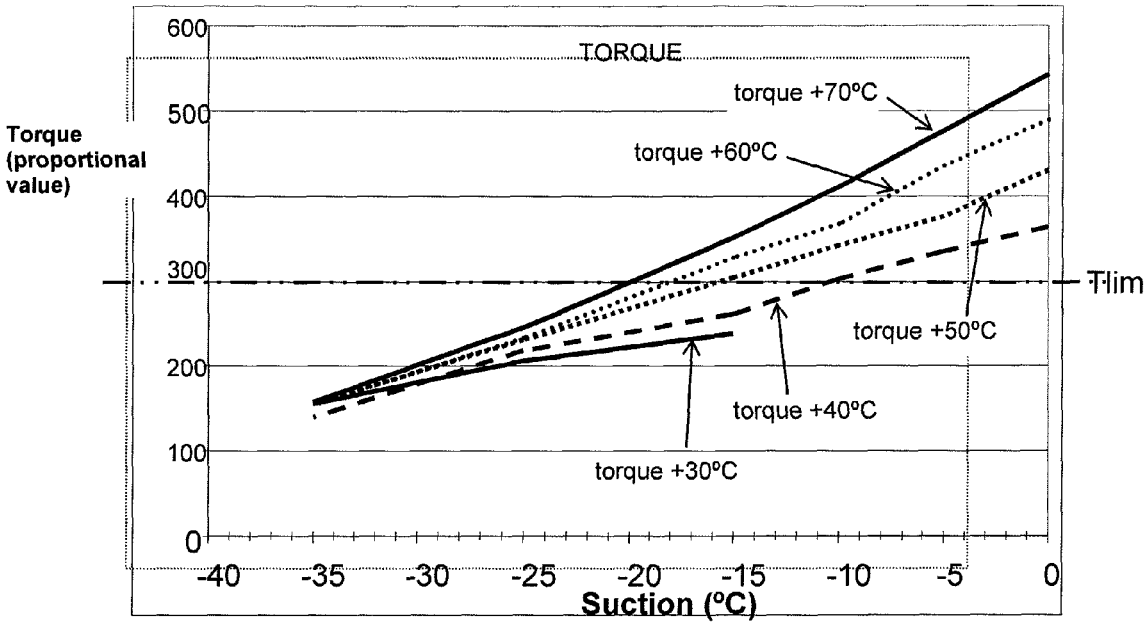
FIG. 5*a* represents a curve illustrating the variation of torque on the motor axle of the compressor with the compression and suction pressures.
Figure 5B:
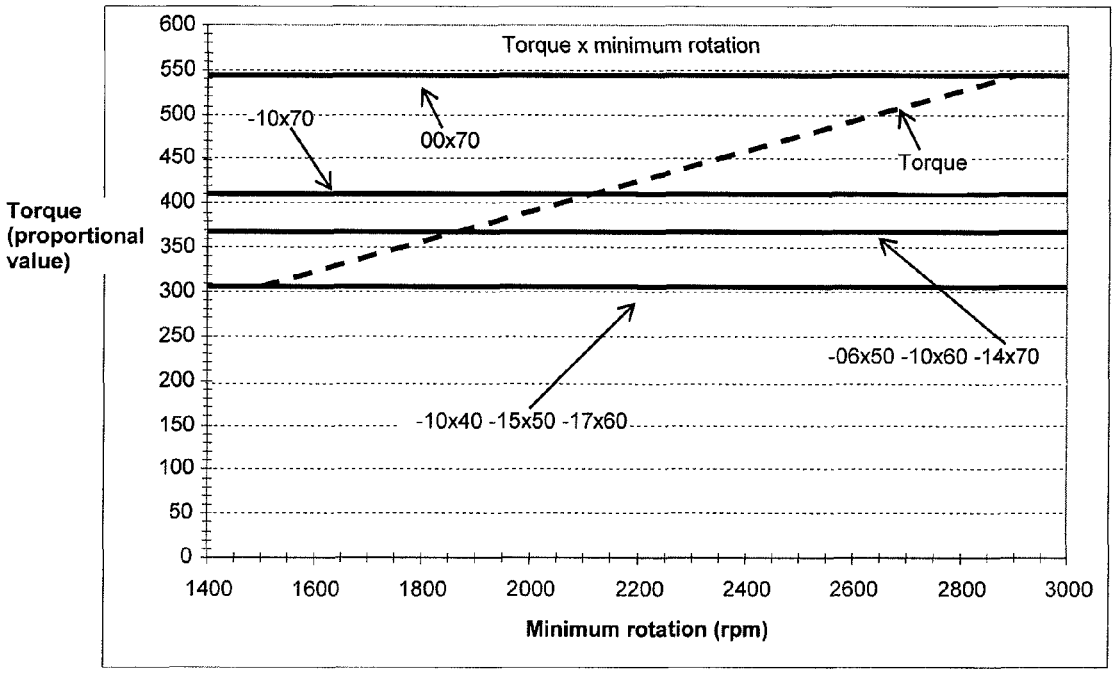
FIG. 5*b* represents a predetermined curve establishing the minimum rotation values that should be imposed on the compressor motor, depending upon the value of the torque existing on the axle, so as to guarantee that the oil film in the bearings will not break.

In FIG. 5*a*, the curves of torque T are drawn for different combinations of condensation and evaporation temperature. The values of torque T shown in this figure were taken directly from the microprocessor 10, without adjustment for a known unit. In the abscissa axis there is an evaporation temperature, ranging from −35° C. to 0° C. and each curve corresponds to a different value of condensation (compression) temperature, ranging from +30 to +70° C. Comparing the curves of torque of FIG. 5*a* with the curves of the oscillation parameter $K_{OSC}$ in FIG. 4*a*, one observes that the variation in torque T depending upon the temperatures of condensation (compression) and evaporation has a behavior similar to the variation of the oscillation parameter $K_{OSC}$, used as a measure for monitoring the bearing-situation variable according to the first embodiment of the present invention. In this way, just as in the case of the oscillation parameter $K_{OSC}$, one can select a predetermined value of torque T above which the protection against break of the lubricating-oil film should be activated. The dashed line in FIG. 5*a* represents the selected value of limit torque $T_{LIM}$. When the protection following the system of the present invention is activated, the rotation of the compressor 21 should be raised. However, unlike what happens with the use of the oscillation parameter $K_{OSC}$, the torque T will not vary with the increase in rotation, since it depends exclusively on the load. So, it is necessary to build a relation of torque x minimum rotation, which will be used for informing by how much one should increase the rotation when the protection is activated. FIG. 5*b* brings an example of the relation torque×minimum rotation. In this case, if we select in FIG. 5*a* the condition −10° C.×70° C., in which the value of torque T is of approximately 410 (a value proportional to the torque T of the motor 20, internally calculated by the microprocessor 10), the protection according to the system of the present invention will be activated and will impose a minimum-rotation value of 2100 rpm, according to FIG. 5*b*.

By using this logic, it is possible to establish a table of torque values and to store it within the microprocessor 10, and thus establish values of limit torque $T_{LIM}$ and minimum rotation RPMmin.

In terms of implementation of the system, the present invention foresees the following method steps:

establishing a bearing-situation variable from the observation of the voltage and of the current in the inverter 2;

establishing a maximum value foreseen for the bearing-situation variable;

raising the rotation of the motor 20 according to a pre-established relation so as to prevent break of the oil film in the compressor bearings.

According to the first embodiment of the present invention, the bearing-situation variable is established by monitoring a time of permanence of the motor 20 in each of the pole positions defined during the rotation of the motor 20, defining an oscillation parameter $K_{OSC}$. The oscillation parameter $K_{OSC}$ is obtained by comparing a maximum commutation time $t_{MAX}$, a minimum commutation time $t_{MIN}$ and an average commutation time $t_{MED}$ of permanence of the motor 20 in each of the pole positions, the oscillation parameter being obtained by means of the equations 1, 2 and 3 already described.

In addition, according to the method, the oscillation parameter $K_{OSC}$ is compared with the maximum value of the oscillation parameter $K_{MAX}$ previously established and corresponding to a minimum rotation RPMmin of the compressor 21, so that, when the value of the oscillation parameter $K_{OSC}$ is higher than or equal to the maximum value of the oscillation parameter $K_{MAX}$, the rotation of the motor/compressor 20, 21 assembly will be raised to rotations that are higher than or equal to the minimum rotation RPMmin.

In general terms, according to the method, the $K_{OSC}$ parameter is used for informing, by means of level of rotation oscillation of the motor 20 in one mechanical turn, in which condition of condensation pressure and evaporation pressure the compressor 21 was, thus enabling the increase of compressor 21 rotation, whenever its value exceeds the pre-established maximum limit value of the oscillation parameter $K_{MAX}$. The increase in rotation should be sufficient to maintain the value of the $K_{OSC}$ parameter always equal to or lower than the maximum value of the oscillation parameter $K_{MAX}$. Thus, one guarantees that the compressor 21 will always operate at a rotation at which there will be no risk of the lubricating-oil film in the bearings breaking, that is, above the minimum rotation RPMmin.

According to the second embodiment of the present invention, the bearing-situation variable is obtained from the torque T close to the motor 20 axle and, more specifically, the bearing-situation variable is obtained by monitoring the value of the level of current circulating through the inverter 2, establishing a torque T value of the motor 20 from the value of current $I_{MED}$, this value of current being average $I_{MED}$, and the torque T being obtained by means of the equations 4 and 5 already described.

The calculated torque T is compared with a predetermined limit value of limit torque $T_{LIM}$. When the torque T on the motor 20 axle exceeds this predetermined value, one checks the table that correlates torque T and minimum rotation RPMmin. For each value of torque T higher than the limit torque $T_{LIM}$, there is a minimum rotation value that should be imposed to the compressor 21, so as to guarantee that the compressor bearings will not suffer solid friction due to the break of the lubricating-oil film.

Thus, according to the control system and method of the present invention, it is possible to achieve the desired objectives. In this way, one manages to prevent the compressor 21 bearings from getting into solid friction caused by the break of the oil film when operating at a low rotation and with high compression (discharge) pressures. One can further use less viscous oils with an objective of increasing efficiency of the compressor, control the system by using a microprocessor, but dispensing with the use of additional sensors in the compressor, since the measurement is made directly at the circuit, without the need to add external sensors.

Preferred embodiments having been described, one should understand that the scope of the present invention embraces other possible variations, being limited only by the contents of the accompanying claims, which include the possible equivalents.

The invention claimed is:

1. A control system for protection against break of the lubricating-oil film in bearings of compressors comprising:

an electric motor of M phases (20) associated to the compressor (21), forming a motor-compressor assembly (20, 21), the compressor (21) having a bearing, the bearing being covered with a lubricating film;

a microprocessor (10), an inverter (2) comprising a set of switches ($SW_{2M}$), the inverter (2) being connected to a voltage ($V_{BARR}$), and associated to the microprocessor (10), the inverter (2) modulating the voltage ($V_{BARR}$) to feed the motor (20), a voltage observer (30) measuring the level of voltage at the output of the inverter (2) and a current observer (40) measuring the current that circulates through the set of switches ($SW_{2M}$) of the inverter (2), associated to the microprocessor (10), wherein the microprocessor (10) actuates the set of switches ($SW_{2M}$) selectively, so as to generate a rotation on the motor-compressor assembly (20, 21), the compressor (21) having a minimum rotation speed (RPMmin) of the compressor (21) so that the oil film will not break, the microprocessor (10) being configured for, on the basis of the information from the voltage observer (30) and/or from the current observer (40), establishing a bearing-situation variable, said bearing-situation variable having a predetermined maximum value, the microprocessor (10) raising the rotation speed of the motor (20) to a value higher than the minimum rotation speed (RPMmin) according to a pre-established relationship of the bearing-situation variable to prevent the breakage of the oil film in the bearing.

2. A system according to claim 1, wherein the bearing-situation variable is determined based upon a signal from a voltage observer (30) associated to the microprocessor (10), the microprocessor (10) monitoring a time of permanence of the motor in each of the pole positions defined during the rotation of the motor (20) to determine the bearing-situation variable from the calculation of a rotation oscillation parameter ($K_{OSC}$).

3. A system according to claim 2, wherein the oscillation parameter ($K_{OSC}$) is obtained from a comparison between a maximum commutation time ($t_{MAX}$), a minimum commutation time ($t_{MIN}$) and an average commutation time ($t_{MED}$) of permanence of the motor (20) in each of the pole positions.

4. A system according to claim 3, wherein the oscillation parameter ($K_{OSC}$) is obtained by means of the following equation:

$$K_{OSC} = \frac{t_{MAX} - t_{MIN} + t_{MED}}{t_{MED}}$$

wherein $$t_{MED} = \frac{t_1 + t_2 + \ldots + t_N}{N}$$

and N being the number of pole positions of the motor (20).

5. A system according to claim 4, wherein the microprocessor (10) is configured for monitoring the oscillation parameter ($K_{OSC}$) and comparing it with a previously established a-maximum value of the oscillation parameter ($K_{MAX}$) and, when the value of oscillation parameter ($K_{OSC}$) is higher than or equal to the maximum value of the oscillation parameter ($K_{MAX}$), raising the rotation speed of the motor-compressor assembly (20, 21) to be higher than or equal to the minimum rotation speed (RPMmin).

6. A system according to claim 1, wherein the bearing-situation variable is obtained from the torque (T) close to an axle of the motor (20).

7. A system according to claim 6, wherein the bearing-situation variable is determined based upon a signal from a current observer (40), the microprocessor (10) monitoring the value of the level of current circulating through the set of switches ($SW_{2M}$), the microprocessor (10) establishing a value of torque (T) of the motor (20) from the value of average current ($I_{MED}$).

8. A system according to claim 7, wherein the value of the torque is obtained from the value of average current ($I_{MED}$).

9. A system according to claim 8, wherein the value of torque (T) is obtained by means of the equation:

$$T = C_M \times I_{MED}$$

wherein ($C_M$) is a constant value of the motor (20).

10. A system according to claim 9, wherein the value of torque (T) is obtained by means of the equation:

$$T = \frac{C_N \times C_M \times P}{R}$$

wherein (P) is the power consumed by the inverter (2) and ($C_N$) is an adjustment constant and (R) is the value of rotation speed of the motor (20) associated to the compressor (21).

11. A system according to claim 10, wherein the microprocessor (10) compares the value of torque (T) with a limit value of torque ($T_{LIM}$) and, when the value of torque (T) exceeds the value of limit torque ($T_{LIM}$), the rotation speed is raised in accordance with a pre-established relationship.

12. A system according to claim 11, wherein the microprocessor (10) comprises a table of torque (T) values with respect to a rotation speed of the motor-compressor assembly (20, 21), the microprocessor (10) adjusting the motor rotation speed to a value previously established, on the basis of the table of torque values.

13. A system according to claim 12, wherein, on the basis of the table showing torque (T) values, each torque (T) value higher than the limit torque ($T_{LIM}$), the microprocessor (10) obtains a value of minimum rotation speed (RPMmin) to be imposed to the motor (20) so as to prevent the breakage of the oil film in the bearing of the compressor (21).

14. A control system for protection against break of the lubricating-oil film in the bearings of hermetic compressors comprising:

an electric motor of M phases (20) associated to the compressor (21), forming a motor-compressor assembly (20, 21), the compressor (21) having a bearing, the bearing being covered with a lubricating film;

a microprocessor (10), an inverter (2) comprising a set of switches ($SW_{2M}$), the inverter (2) being connected to a voltage ($V_{BARR}$), and associated to the microprocessor (10), the inverter (2) modulating the voltage ($V_{BARR}$) to feed the motor (20), a voltage observer (30) measuring the voltage level at the output of the inverter (2) and a current observer (40) measuring the current circulating through the set of switches ($SW_{2M}$) of the inverter (2), associated to the compressor (10), wherein the microprocessor (10) actuates the set of switches ($SW_{2M}$) selectively, so as to generate a rotation speed on the motor-compressor assembly (20, 21), the compressor (21) having a minimum rotation speed (RPMmin) of the compressor (21) so as to prevent the oil film from being broken, the microprocessor (10) being configured for, on the basis of the information from the voltage observer (30) and/or from the current observer (40), establishing a bearing-situation variable and, if the bearing-situation variable reaches a maximum value foreseen, the inverter (2) is commanded so that the motor-compressor assembly can have a rotation higher than the minimum rotation (RPMmin) according to the pre-established relation of the bearing-situation variable so as to prevent the breakage of the oil film in the bearing.

15. A system according to claim 14, wherein the bearing-situation variable is obtained by means of the voltage observer (30) associated to the microprocessor (10), the microprocessor (10) monitoring the time of permanence of the motor in each of the pole positions defined during the rotation of the motor (20) for obtaining the bearing-situation variable on the basis of the calculation of a rotation oscillation parameter ($K_{OSC}$), the oscillation parameter ($K_{OSC}$).

16. A system according to claim 14, wherein the bearing-situation variable is obtained from the torque (T) close to the axle of the motor (20).

17. A method for protection against breaking of lubricating-oil film in a compressor bearing, the compressor (21) being actuated by an electric motor (20), an inverter (2) being connected to a voltage ($V_{BARR}$), the inverter (2) being actuated to feed the motor (20) and thus bring about a rotation of the motor (20), wherein the method comprises the steps of:

measuring a voltage and/or a current in the inverter (2);

determining a bearing-situation variable based upon the voltage and/or the current in the inverter (2);

establishing a predetermined maximum value for the bearing-situation variable;

raising the rotation speed of the motor (20) according to a pre-established relation so as to prevent the breakage of the oil film in the compressor bearing.

18. A method according to claim 17, wherein the bearing-situation variable is determined by monitoring a time of permanence of the motor (20) in each of the pole positions defined during the rotation of the motor (20) and determining the bearing-situation variable from an oscillation parameter ($K_{OSC}$).

19. A method according to claim 18, wherein the oscillation parameter ($K_{OSC}$) is obtained by comparing a maximum commutation time ($t_{MAX}$), a minimum commutation time ($t_{MIN}$) and an average time ($t_{MED}$) of permanence of the motor (20) in each of the pole positions.

20. A method according to claim 19, wherein the oscillation parameter ($K_{OSC}$) is obtained by means of the following equation:

$$K_{OSC} = \frac{t_{MAX} - t_{MIN} + t_{MED}}{t_{MED}},$$

wherein

-continued $$t_{MED} = \frac{t_1 + t_2 + \ldots + t_N}{N}$$

and N being the number of positions of the motor (20).

21. A method according to claim 20, further comprising a step of monitoring the oscillation parameter ($K_{OSC}$) and comparing it with a maximum value of the oscillation parameter ($K_{MAX}$) previously established and corresponding to a minimum rotation speed (RPMmin) of the compressor (21), so that, when the oscillation parameter value ($K_{OSC}$) is higher than or equal to the maximum value of the oscillation parameter ($K_{MAX}$), the rotation speed of the motor-compressor assembly (20, 21) will be raised to rotations speed higher than or equal to the minimum rotation speed (RPMmin).

22. A method according to claim 17, wherein the bearing-situation variable is obtained from the torque (T) close to the axle of the motor (20).

23. A method according to claim 22, wherein the bearing-situation variable is obtained by monitoring the value of the level of current circulating in the inverter (2), establishing a value of torque (T) of the motor (20) from the value of average current ($I_{MED}$).

24. A method according to claim 23, wherein the torque (T) value is obtained from a value of average current ($I_{MED}$).

25. A method according to claim 24, wherein the torque value (T) is obtained by means of the equation:

$$T = C_M \times I_{MED}$$

wherein ($C_M$) is a constant value of the motor (20).

26. A method according to claim 25, wherein the torque (T) value is obtained by means of the equation:

$$T = \frac{C_N \times C_M \times P}{R}$$

wherein (P) is power consumed by the inverter (2) and ($C_N$) is an adjustment constant and (R) is the value of the rotation speed of the motor (20) associated to the compressor (21).

* * * * *